US005507364A

United States Patent [19]

Spevak

[11] Patent Number: 5,507,364

[45] Date of Patent: Apr. 16, 1996

[54] LADDER LEVELER

[76] Inventor: Stephen T. Spevak, 881 McDonald Rd., Winchester, Va. 22602

[21] Appl. No.: 314,721

[22] Filed: Sep. 29, 1994

Related U.S. Application Data

[63] Continuation-in-part of Ser. No. 10,660, Jul. 14, 1993, Pat. No. Des. 359,366.

[51] Int. Cl.[6] ..... E06C 7/44

[52] U.S. Cl. ..... 182/200; 182/204

[58] Field of Search ..... 182/200–205, 182/107, 111; 248/188.2

[56] References Cited

U.S. PATENT DOCUMENTS

| | | | |
|---|---|---|---|
| 666,526 | 1/1901 | Howard . | |
| 973,103 | 10/1910 | Boyd . | |
| 1,154,614 | 9/1915 | Crofts . | |
| 1,329,740 | 2/1920 | Barron . | |
| 1,516,968 | 11/1924 | Redman . | |
| 2,147,052 | 2/1939 | Noone . | |
| 2,327,317 | 8/1943 | Randall . | |
| 2,449,609 | 9/1948 | Linder . | |
| 3,173,512 | 3/1965 | Sturdy . | |
| 3,233,702 | 2/1966 | Feltrop . | |
| 4,807,720 | 2/1989 | Kim . | |
| 4,896,745 | 1/1990 | Warnelou | 248/188.2 |
| 4,984,655 | 1/1991 | Scherer . | |
| 5,044,468 | 9/1991 | Worthington . | |

FOREIGN PATENT DOCUMENTS

| | | | |
|---|---|---|---|
| 147367 | 2/1950 | Australia | 182/202 |
| 2621952 | 4/1989 | France | 182/204 |
| 563521 | 6/1975 | Switzerland | 182/200 |

*Primary Examiner*—Alvin C. Chin-Shue
*Attorney, Agent, or Firm*—Terry M. Gernstein

[57] ABSTRACT

A ladder leveler includes a frame unit that is adjustable in two degrees of freedom and has a wide range of adjustment. The rungs of a ladder being leveled are supported, and brakes are located between the rung supporting element and the remainder of the frame unit. The brakes can be located between the rung supporting element and crossbars on the frame unit and/or between the crossbars and stanchions of that frame unit. At least two rungs of the ladder are supported. If three rungs are supported, one of the rungs will be supported from beneath that rung, and the stanchions are telescoping.

20 Claims, 10 Drawing Sheets

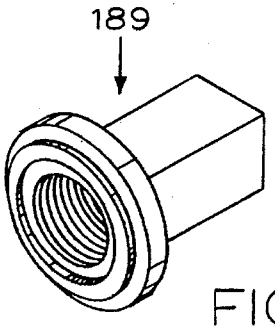
FIG. 20
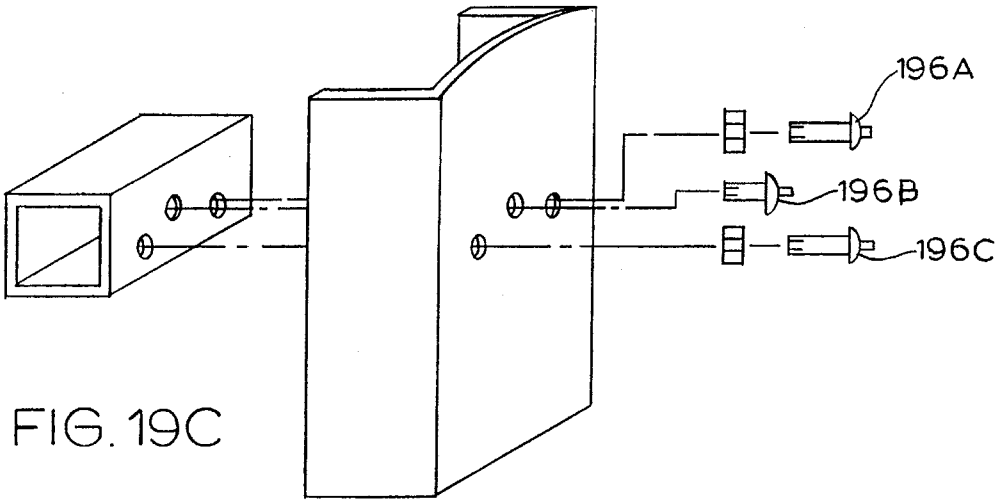
FIG. 19C
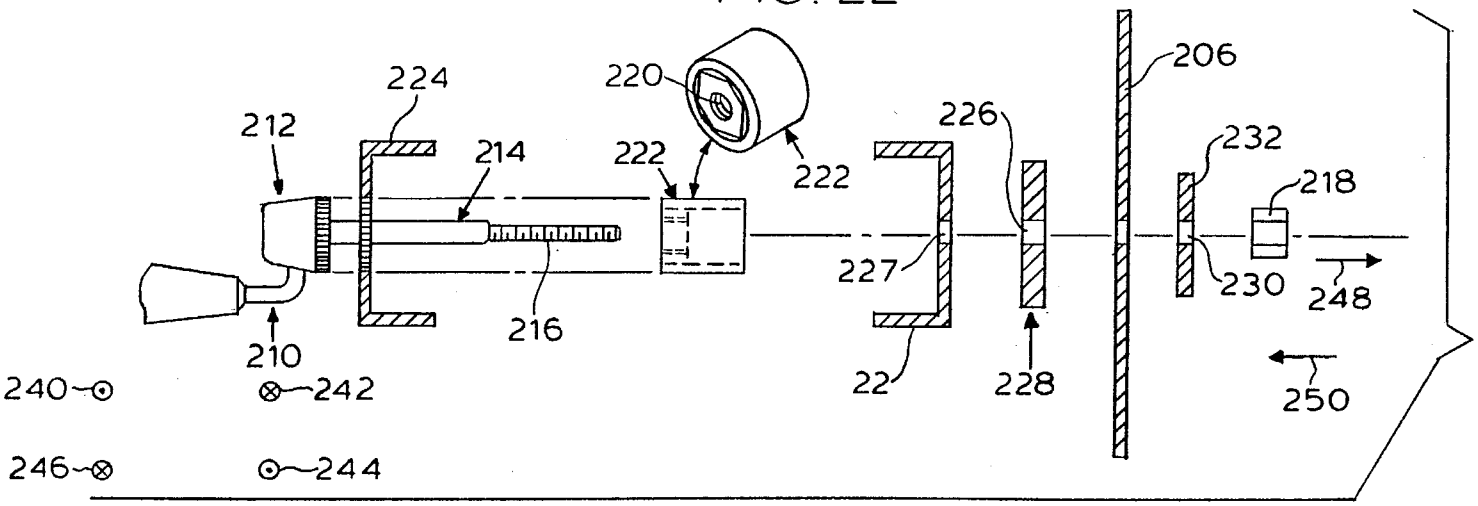
FIG. 21
FIG. 22

LADDER LEVELER

CROSS REFERENCE TO RELATED APPLICATIONS

The present application is a continuation-in-part of application Ser. No. 29/010,660, filed on Jul. 14, 1993, U.S. Pat. No. 1,359,366, filed Jun. 13, 1995, the disclosure of which is incorporated herein by reference.

TECHNICAL FIELD OF THE INVENTION

The present invention relates to the general art of ladders, and to the particular field of ladder levelers.

BACKGROUND OF THE INVENTION

Anyone who has ever used a ladder, especially a long (i.e., forty feet or longer) ladder, has experienced the problems associated with setting the ladder on an uneven surface. Not only is this an onerous problem, it can be dangerous as well if the ladder is not properly leveled. The problems associated with leveling a ladder are exacerbated by long ladders.

Therefore, the art includes many proposals for ensuring a level and stable setting for a ladder. These proposals include extensions for one of the ladder legs, frame units extending through the ladder legs, and the like. While somewhat successful, these devices have several drawbacks which inhibit their commercial acceptance.

For example, many of the prior art devices require modification of the ladder. Therefore, these devices are best mounted on the ladder by the manufacturer. This can increase the cost of the ladder, which can be very detrimental in a highly competitive market such as this one. It also nearly totally precludes an after-market. Such devices also may present storage problems.

Another drawback to many prior art ladder levelers is the difficulty of accurately leveling the ladder. Some devices actually require two people to effect the leveling, and many cannot be leveled while the ladder is in use. Difficulty of use is a major consideration in a market which contains many choices, such as ladders and ladder accessories.

Still another drawback to many prior art ladder levelers is the limited range of adjustment thereof. The range is limited either by the construction or by the inter-relationships of the elements or the stability of the leveler, especially if a long ladder is being leveled. Some ladder levelers cannot be used on stairs because the range of the leveler is not sufficient to compensate for the sharp rise of the stairs coupled with the limited horizontal area available for the feet of the leveler to rest on.

Yet another drawback to many prior art ladder levelers is the lack of support available for the ladder rungs. The present inventor has determined that ladder rungs undergo great stress during use, and such stress may be detrimental, especially if some of the support of the ladder on a leveling device is being produced by the rungs. Any deformation of the rungs may not be desirable.

Still further drawbacks to many prior art ladder levelers is associated with the stability of the leveled ladder. The attachment of the ladder leveling device to the ladder should be as secure as possible in order to increase the safety features of the combination.

Therefore, there is a need for a wide range ladder leveling device that is easily attached to and detached from a ladder without requiring modification of the ladder yet, once attached, will be extremely secure, accurate and stable and will support the rungs of the ladder.

OBJECTS OF THE INVENTION

It is a main object of the present invention to provide a ladder leveler.

It is another object of the present invention to provide a ladder leveler that is easily attached to and detached from a ladder.

It is another object of the present invention to provide a ladder leveler that is stable, secure and accurate.

It is another object of the present invention to provide a ladder leveler having a wide range of adjustment.

It is another object of the present invention to provide a ladder leveler which can be attached and detached by one person.

It is another object of the present invention to provide a ladder leveler which can be adjusted when a user is on the ladder.

It is another object of the present invention to provide a ladder leveler which supports the rungs of the ladder.

It is another object of the present invention to provide a ladder leveler which can be easily stored.

SUMMARY OF THE INVENTION

These, and other, objects are achieved by a ladder leveler which includes a frame that is easily adjustable in two directions over a wide range, yet is secure and stable once set and which supports the rungs of the leveled ladder.

More specifically, the frame unit includes a rung support element that is attached to a crossbar and to stanchions by brake means. The crossbars of the frame unit are movable with respect to the stanchions, and the stanchions include telescoping sections whereby a wide range of movement is achievable. The ladder rungs are supported and bearing pads are located between the ladder and the leveler frame unit to prevent undesired movement between the ladder and the frame unit. The brake means can be located between elements of the frame unit and/or between the crossbars and the stanchions and includes a friction pad as well as a bolt attached to one element and means attached to another element so movement of the elements relative to each other is controlled.

In this manner, the ladder leveler is easily attached to a ladder by one person without requiring modification of the ladder, and is easily set and/or adjusted by one person, even if that user is on the ladder, yet will be secure, stable and accurate once set. The large range of adjustment available permits the ladder leveler to be used on ladders resting on stairs. The support of the rungs increases safety factors for the ladder.

BRIEF DESCRIPTION OF THE DRAWINGS FIGURES

FIG. 19C is an exploded perspective view of the stop means used to limit the travel of the crossbar.

FIG. 20 is a fastener element used in the brake means shown in FIGS. 19A and 19B.

FIG. 21 is an exploded top view of the brake means shown in FIGS. 19A–19C.

FIG. 22 is a perspective view of a spacer element used in the brake means.

DETAILED DESCRIPTION OF THE PREFERRED EMBODIMENT OF THE INVENTION

Figure 5:
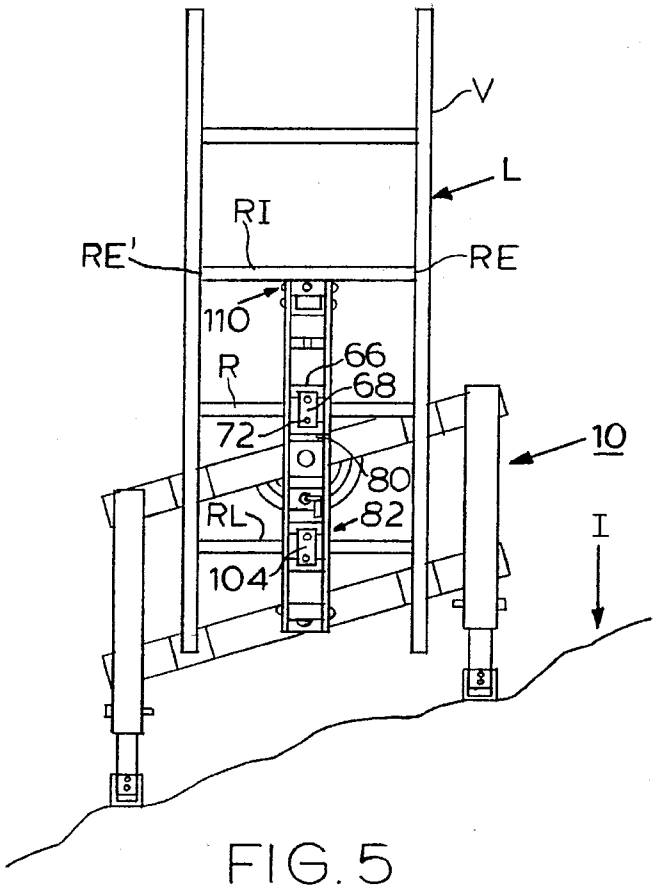
FIG. 5 is an elevational view of a ladder in combination with the ladder leveler illustrating use of the device on a hill.
Figure 4:
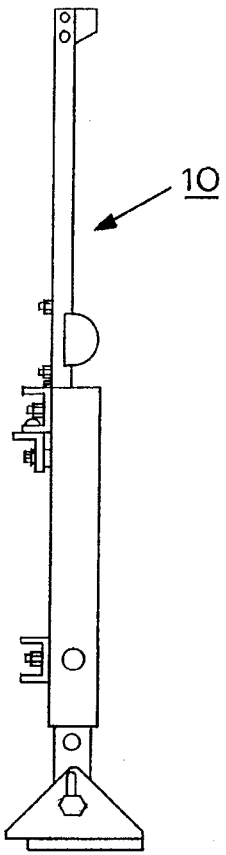
FIG. 4 is a side elevational view thereof, the side opposite being identical to the side shown.
Figure 6:
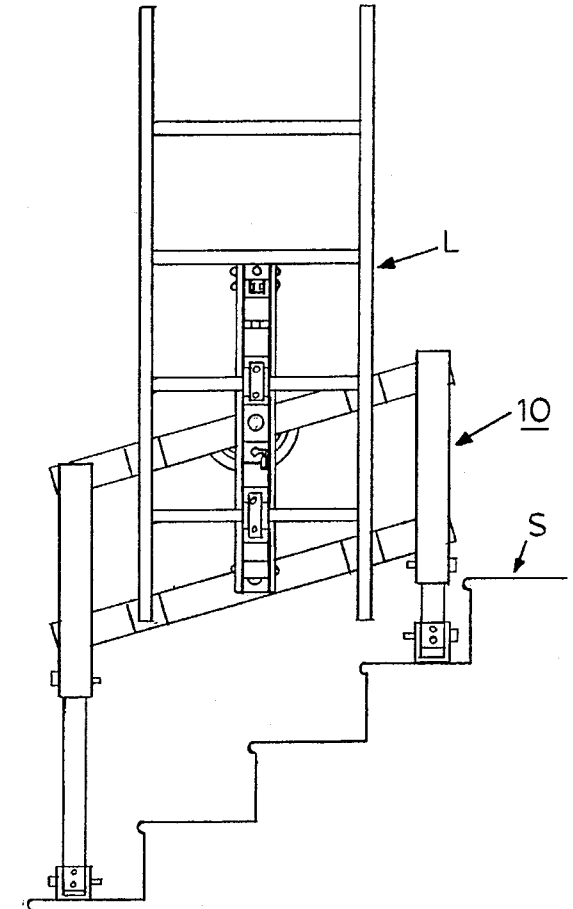
FIG. 6 is an elevational view of a ladder in combination with the ladder leveler illustrating use of the device on stairs, with one of the stanchions fully extended for further adjustment of the leveling.

Shown in FIGS. 1–4 is a ladder leveler 10 embodying a first form of the present invention. Ladder leveler 10 supports three rungs of the ladder being leveled and thus provides a stable and secure base on which the ladder is supported. Leveler 10 is shown in FIGS. 5 and 6 in combination with a ladder L which is being leveled on an incline I (FIG. 5) and on stairs S (FIG. 6). As can be seen by comparing FIGS. 5 and 6, the ladder is leveled over a wide range of slopes and can be adjusted in two planes as will be understood from the following discussion. With regard to FIG. 6, many prior art ladder levelers cannot be used on stairs because of a limited range of adjustment available or because adjustment can be effected by only a single mechanism; whereas, ladder leveler 10 has the ability to adjust using a pivotal mechanism and/or using a telescoping mechanism and thus has at least two degrees of freedom of adjustment. The ladder leveler 10 also includes a level indicator LI to further assist a user in ensuring that the ladder is properly leveled.

Referring to FIGS. 1–4, ladder leveler 10 is seen to include a frame unit 12 having stanchions 14 and 16 connected by crossbars 18 and 20 to which a central rung supporting post 22 is connected. A brake means connects post 22 to the frame unit, and, in leveler 10 shown in FIGS. 1–4, includes a first brake portion 24 connecting post 22 to crossbar 20 and a second brake portion 26 connecting post 22 to crossbar 18. The brake means permits post 22 to move with respect to the crossbars as indicated by double-headed arrow 28, and further includes a third brake portion 30 pivotally connecting each of the crossbars to the stanchions whereby the crossbars can move with respect to the stanchions in directions 32' and 32" as indicated by the double-headed arrow 32 in FIG. 2.

Figure 2:
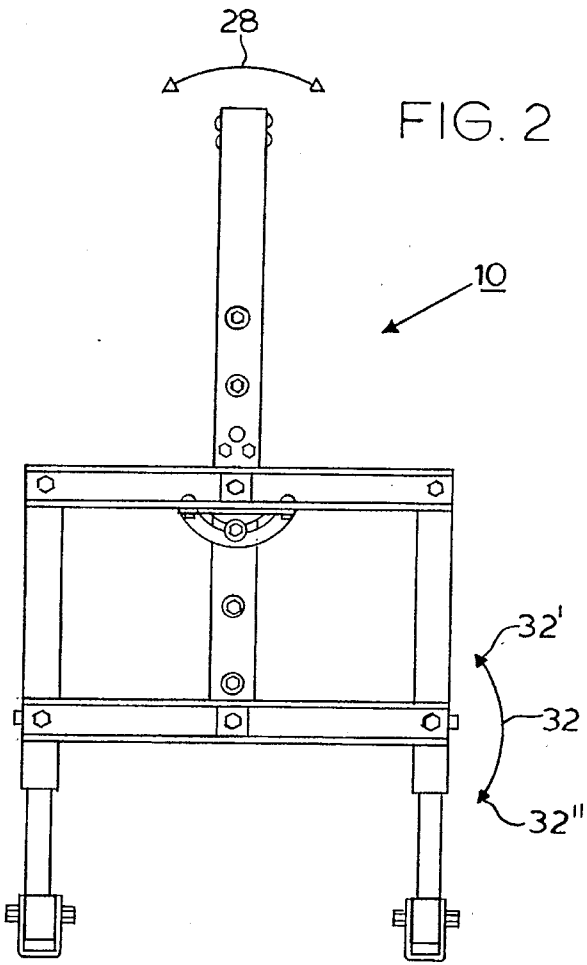
FIG. 2 is a front elevational view thereof.
Figure 1:
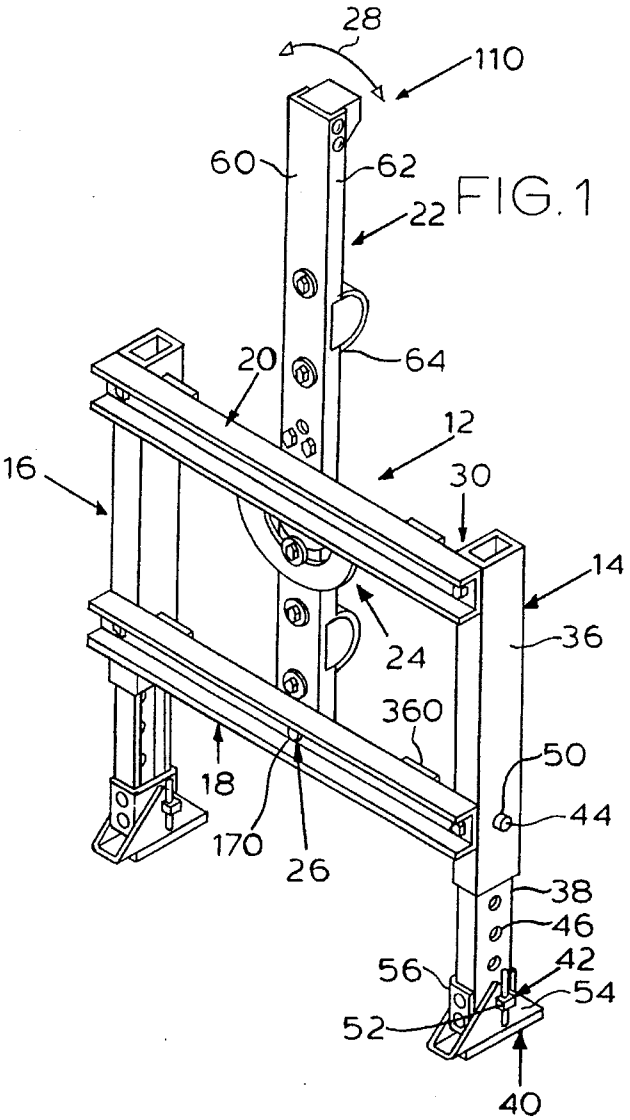
FIG. 1 is a front, top and side perspective of a first form of the ladder leveler embodying the present invention in which three rungs of a leveled ladder will be supported.

The pivotal adjustment of the crossbars with respect to the post 22 and/or with respect to the stanchions is one mechanism for adjusting the leveler, and another mechanism is provided by a telescoping feature of the stanchions 14 and 16. As shown in FIG. 1, each stanchion includes a first section 36 which telescopingly receives a second section 38 to which a foot 40 is pivotally attached by pivot means 42. As can be seen in the figures, section 38 can be extended from one stanchion far enough to provide a wide range of leveling particularly in a vertical direction. Section 38 is attached to section 36 by a fastener, such as fastener 44 accommodated in holes, such as hole 46, in section 38 and aligned with a hole 50 in section 36. Pivot means 42 includes a pivot pin 52 received through a bore defined through an ear 54 of foot 40 and a corresponding hole defined through one wall of section 38. A sleeve 56 slidably receives section 38 in a secure manner.

As can be seen in FIGS. 5 and 6, leveler 10 is wider than ladder L and is connected to the ladder at the rungs, such as rung R, of the ladder. Leveler 10 supports the rungs whereby a secure and stable attachment is made and the rungs are not likely to deform during use. The rung support is effected in several ways in leveler 10. First, the rungs are supported externally by rung support means on the leveler as shown in FIGS. 5 and 6, and internally as shown in FIGS. 8A–11. Leveler 10 supports three rungs of the ladder and thus is quite secure. It is noted that the internal connection is optional as suitable.

Figure 7:
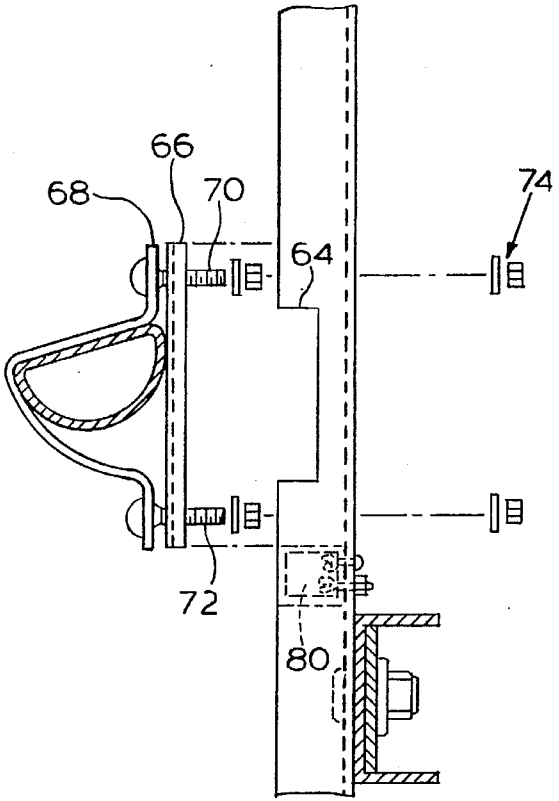
FIG. 7 is an exploded side elevational view of a portion of a rung supporting means for supporting a rung of a ladder.
Figures 14, 15:
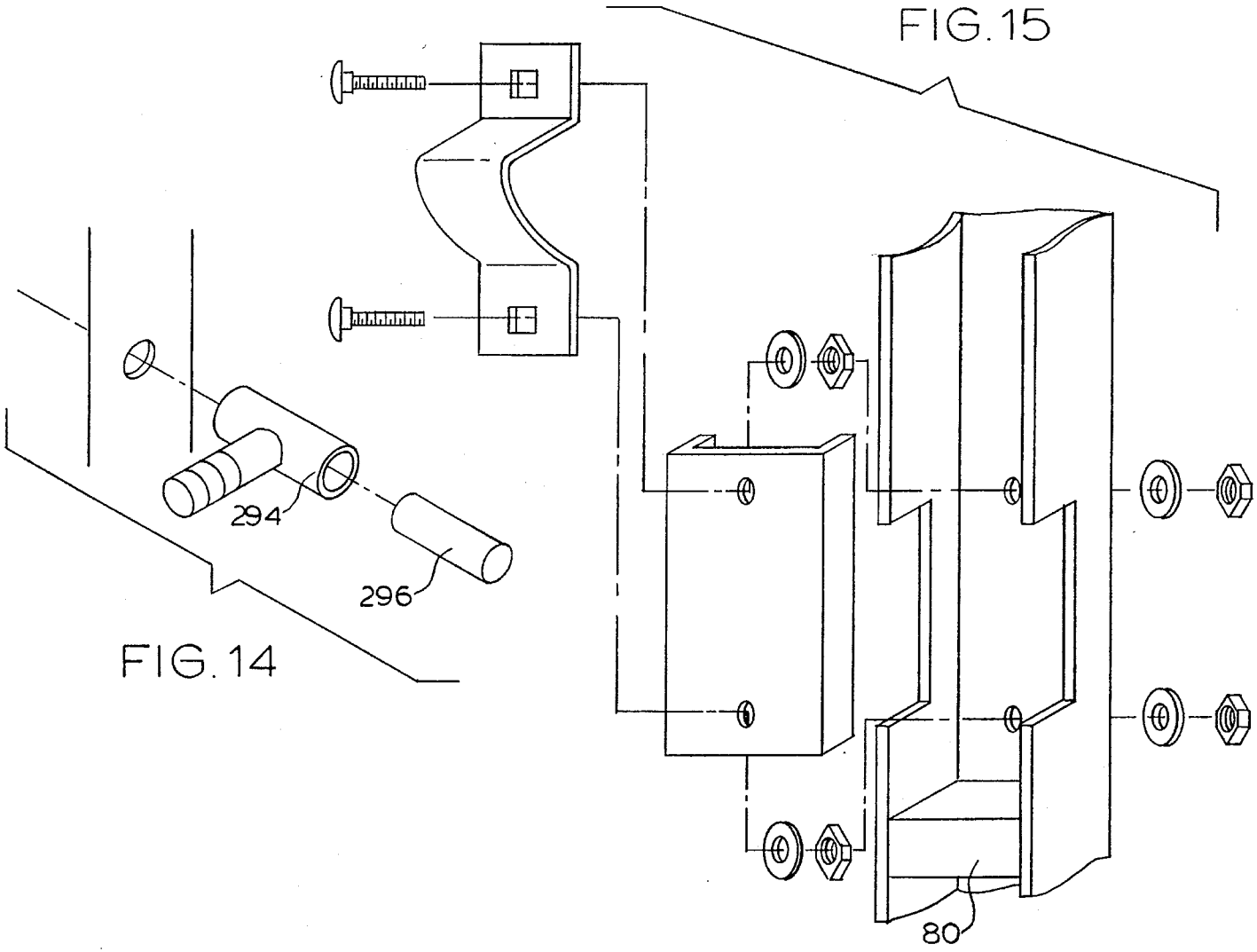
FIG. 15 is an exploded perspective view of a rung supporting element.

One portion of the rung support means is on post 22 and is best shown in FIGS. 1, 7 and 15. Post 22 is U shaped and includes a base 60 and two sides 62. A cutout section 64 is defined through each side 62 and a ladder rung is received in the cutout sections. As indicated in FIG. 8B for example, the ladder rung is D shaped with a planar portion RP and an arcuate portion RA and is hollow to define an interior volume RV extending from one end RE to the other RE' of the rung which are attached to the ladder vertical runners V as is shown in FIG. 5. A U-shaped plate 66 is attached to the rung by a strap 68 that is mounted to the plate by fasteners 70 and 72 extending through the plate and through base 60 with nuts 74 being threadably attached to the bolts. Strap 68 tightly holds the rung against plate 66, and an insert element 76 (see FIG. 9B) formed of flexible material, such as rubber, plastic, or the like, is interposed between the strap and the rung to ensure a stable anchoring of the rung to the plate and to protect the rung.

As is best shown in FIGS. 7 and 15, a square tube support block 80 is mounted to post 22 beneath the location at which plate 66 will be attached to the post. Block 80 not only serves to support the plate, but it also serves to align the plate so that plate holes will align with holes defined through post 22 for receiving bolts 70 and 72 whereby the rung is quickly, yet reliably attached to post 22.

Figure 16:
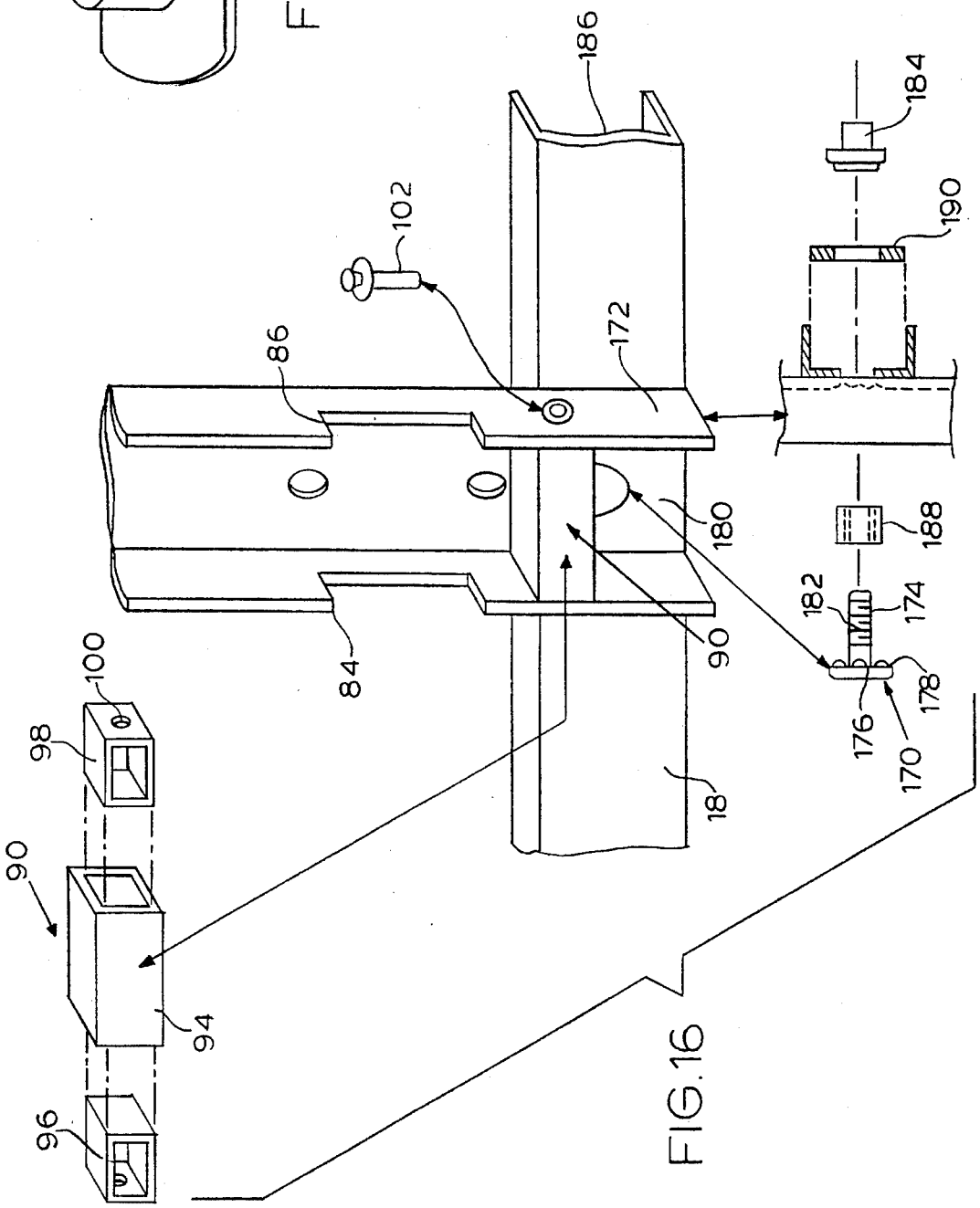
FIG. 16 is an exploded perspective view of a block portion of the rung supporting element.

Ladder lower rung RL is mounted in a second rung support 82, which is best shown in FIGS. 5, 7 and 16 as including two cutout sections 84 and 86 defined in the sides of the post and into which lower rung RL is received. A support block 90 is attached to the post beneath the cutout sections 84 and 86 and is attached to the post sides by fasteners. Support 90 includes a central section 94 having two end sections 96 and 98 received therein. Each of the end sections includes a fastener-receiving hole, such as hole 100, defined therethrough, and each fastener includes a rivet, such as rivet 102, which couples block 90 to the post via end sections 96 and 98. A means 104 attaches the rung RL to the post 22, and an insert, such as insert 76 discussed above, can be inserted between the strap and the rung. Means 104 corresponds and is identical to elements 66–74 discussed above in regard to FIG. 5. Thus, the ladder leveler includes two identical means 104.

Figure 18:
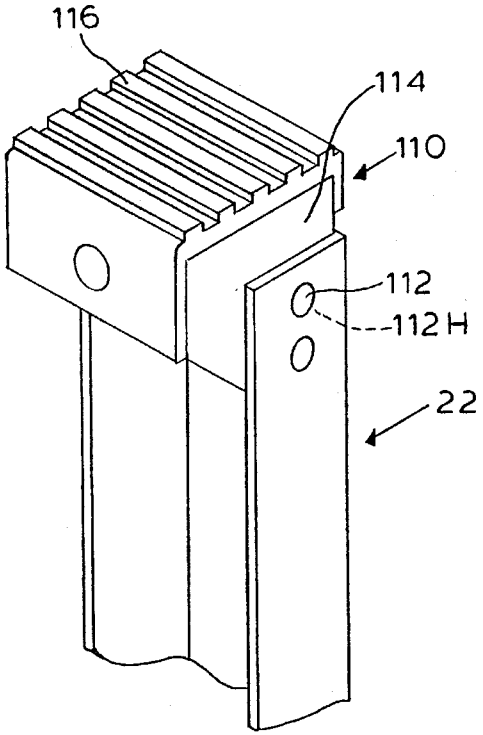
FIG. 18 is a top, side and rear perspective view of a rung supporting element.

As can be understood from the foregoing, both rungs R and RL are supported by ladder leveler 10. Still further support for the ladder rungs is provided by leveler 10 by a support 110, best shown in FIGS. 1, 5 and 18. Support 110 is mounted on a top end of post 22 by fasteners 112 connecting sides 62 to sides 114 of the support 110. Support 110 includes a plurality of ribs 116 defined in a top surface thereof and which engage the bottom of a ladder rung RI. Support 110 is adjustable with respect to post 22 and has an elongate opening defined in side 114 through which fasteners 112 are received. An alternative form will delete the elongated opening and will include pre-existing holes 112H in post 22 which receive fasteners 112, and corresponding holes are drilled in sides 114 after support 110 has been positioned to support a ladder rung. The alternative form ensures a more secure attachment between support 110 and post 22 than the attachment using an elongated hole in support 110. When support 110 is positioned to abut rung RI, the fasteners are set to hold support 110 in position to firmly and securely engage rung RI.

Figure 8A:
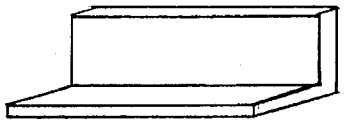
FIGS. 8A–11 show various forms of rung supporting means which are located inside a ladder rung.
Figure 8B:
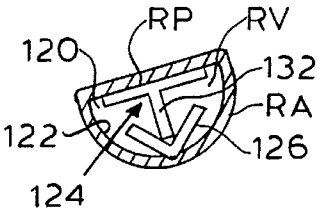
Figure 10:
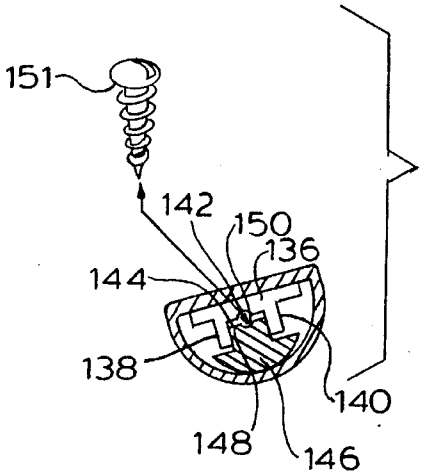
Figure 11:
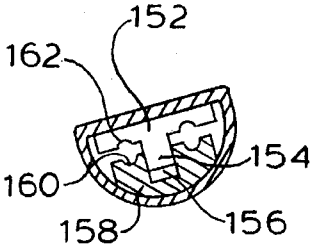
Figure 9A:
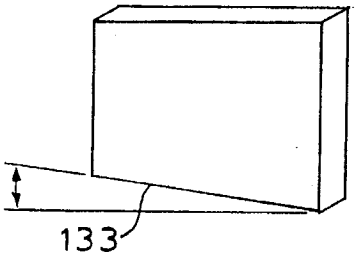
Figure 9B:
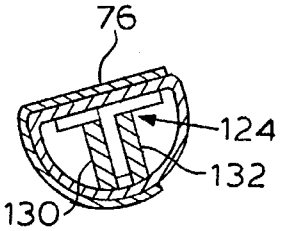

Still further support is provided to the ladder rungs by insert means best shown in FIGS. 8A–11. The insert means is located in inner volume RV of the rungs and includes a first element engaging inner surface 120 of the rung behind planar surface RP and second element engaging inner surface 122 behind arcuate section RA. One of the first and second elements extends for the entire length of the rung, with the other element being driven into each end of the rung. One form of the insert means is shown in FIGS. 8A and 8B, and includes a first element, such as T-shaped element 124, and a second element, such as a V-shaped element 126. The apex of the V-shaped element engages the rung to dig into surface 122 as shown in FIG. 8B. A second form of the insert means is shown in FIGS. 9A and 9B, and includes T-shaped element 124 and elements 130 each of which includes a tapered lower edge 133 and which are forced into volume RV on either side of a leg 132 of the T-shaped element. A third form of the insert means is shown in FIG. 10, and includes a first element 136 having two legs 138 and 140 with an arcuate section 142 defined in surface 144 located between the legs. A second element 146 includes a distal end 148 having an arcuate section 150 defined therein. A sheet metal screw 151 is received between arcuate sections 142 and 150 to force elements 136 and 146 against the inner surfaces of the rung. Another insert means is shown in FIG. 11 and is similar to the insert means shown in FIG. 9A and 9B, and includes a T-shaped element 152 having a leg 154 received in channel 156 of second element 158. Arcuate sections 160 and 162 receive fasteners, such as sheet metal screw 152 to secure the insert means in place in the rung.

Figure 17:
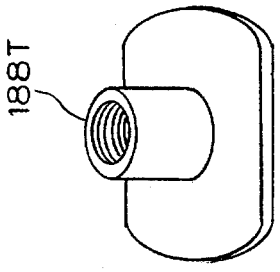
FIG. 17 is a fastener element used to connect a central rung supporting element to a crossbar.
Figure 19A:
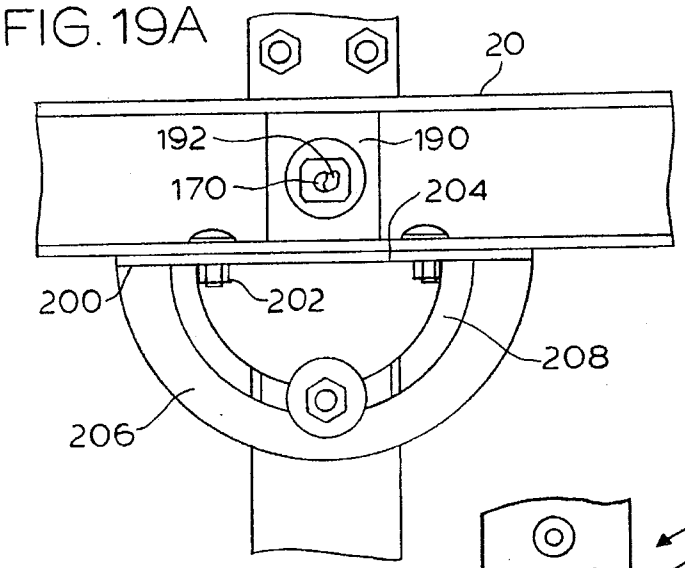
FIG. 19A is a front elevational view of a brake means which connects a central rung supporting element to a crossbar of the frame unit.

Post 22 is secured to the remainder of the frame unit by a brake means that permits the post to move in directions 28 as above discussed. One form of the brake means is shown in FIGS. 1, 16 and 19 and includes a pivot pin 170 attaching post 22 to crossbar 18. Pivot pin 170 includes bolt 174 having head 176 with projections 178 thereon to engage surface 180 of post 22 and a body 182 having threads thereon for engaging nut 184 that engages surface 186 of crossbar 18, with bolt body extending through aligned holes defined in post 22 and crossbar 18. Engaging nut 184 is also shown in FIG. 17. A spacer element 188 surrounds body 182 and a friction pad 190 is interposed between nut 184 and surface 186 to control movement of bolt 170, and hence post 22, with respect to crossbar 18. As indicated in FIG. 1, there are two bolts 170, one attaching the post to each of the crossbars. Spacer 188 is the barrel from a T-nut 188T such as shown in FIG. 17. Nut 184 is welded to bolt by a weld 192, and the projections 178 engage corresponding dimples defined in the surface 180 to ensure that bolt head 176 is fixed to its adjacent element. In this manner, total control over movement is exerted by the brake means and its friction materials. Other means for connecting nut 184 to bolt 174 can be used if suitable.

Figure 19B:
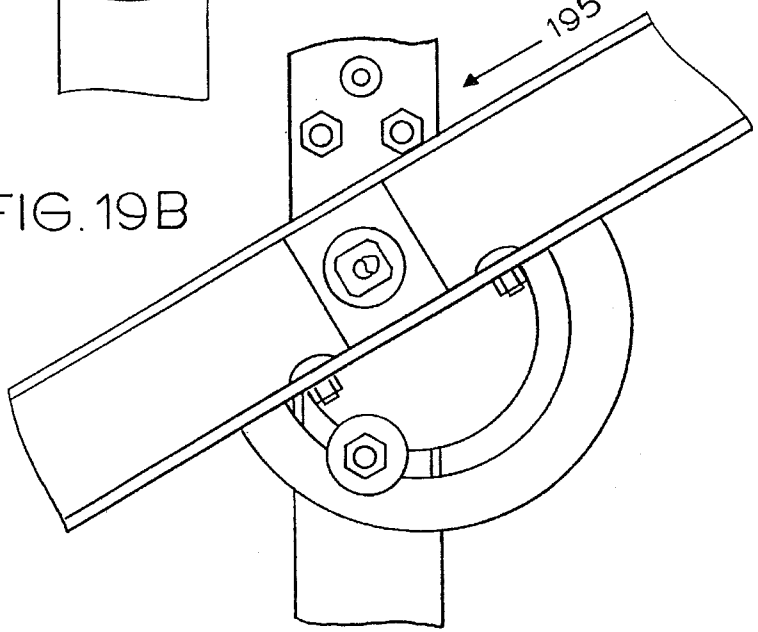
FIG. 19B shows the crossbar in a tilted condition with means for limiting the travel of that crossbar.

A stop means 195, best shown in FIGS. 19B and 19C, limits the travel of the crossbar. Stop means 195 includes two fasteners 196A and 196C fixed to post 22. A third fastener 196B further attaches the block 80 to post 22. The crossbar abuts either fastener 196A or 196C and stops pivoting. Further, by limiting the travel of the crossbar, if a user places his or her finger in groove 208, that finger will not be injured by being caught between the crossbar and the post. Thus, the stop means also functions as a safety feature.

A further portion of the brake means is best shown in FIGS. 1, 2, 19A, 19B and 21 and includes a first plate 200 attached by fasteners 202 to the bottom of crossbar 20. Plate 200 is L shaped and includes a rectangular section 204 and an arcuate section 206 having an arcuate slot 208 defined therein to intersect plate 204. A safety feature is provided by having slot 208 extend for the entire length of plate 206. This extent of the slot provides room for a user's fingers. A brake handle 210 is connected to a head 212 which has a bolt shank 214 attached thereto. An external thread 216 is defined on the shank and engages a nut 218 after extending through a bore 220 of a spacer element 222, a bore through a U-shaped element 224, bore 226 of friction pad 228, a bore 227 of post 22, arcuate slot 208 and bore 230 of washer 232. Handle 210 pivots into and out of the plane of the paper as indicated by arrows 240 and 242, and arrows 244 and 246. When the handle is pivoted in direction 240, 242, it moves nut 218 in direction 248 away from plate 206 to release post 22 from the remainder of the frame unit by releasing the abutting and frictional engagement between post 22 and plate 206 via friction pad 228, and when the handle is pivoted in direction 244, 246, it moves nut 218 in direction 250 toward plate 206 to engage post 22 with the remainder of the frame unit by forcing plate 206 into frictional engagement with post 22 via the friction pad 228. Handle 210 is an over-the-center cam type handle that effects the just-described translational movement when it is pivoted.

Use of the just-described brake means is effected by operating handle 210 to release post 22 from the frame unit, pivoting the post into the desired angular orientation with respect to the remainder of the frame unit, and then pivoting handle 210 in the opposite direction to attach the post to the frame unit.

Figure 25:
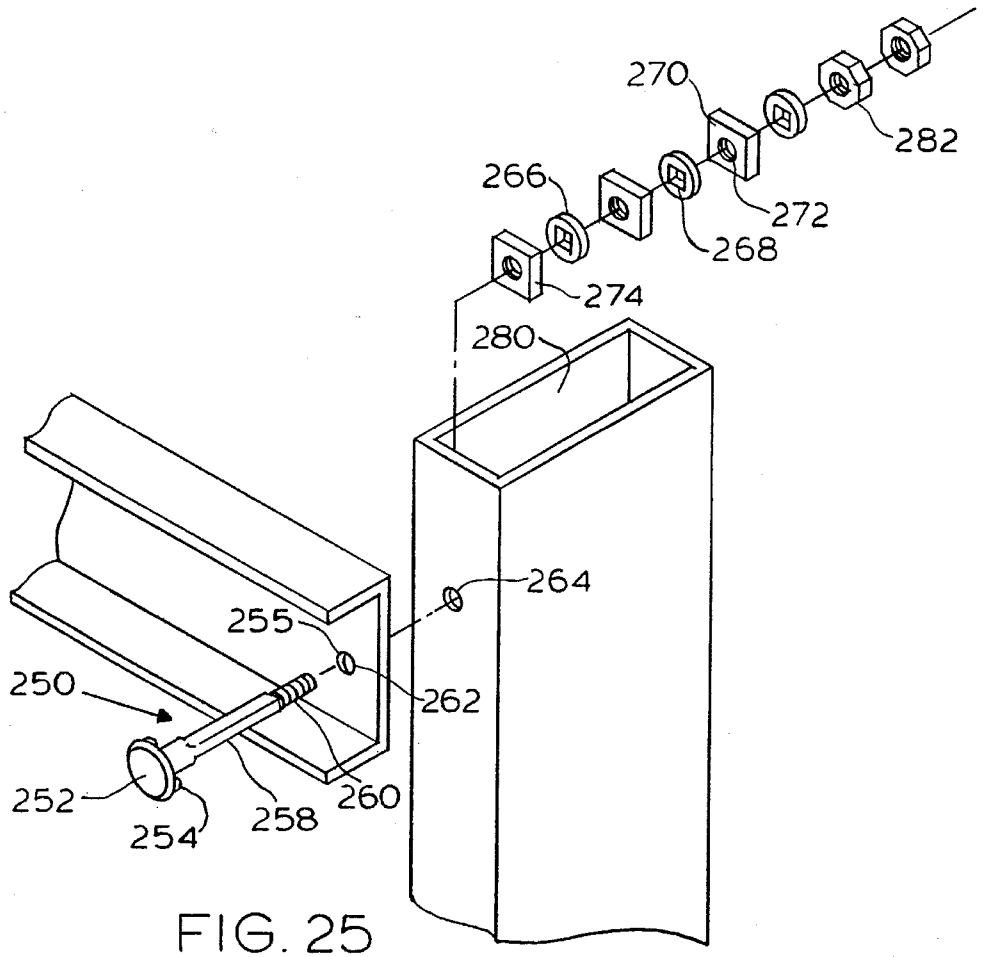
FIG. 25 is an exploded perspective view of the brake means shown in FIG. 23.
Figure 24:
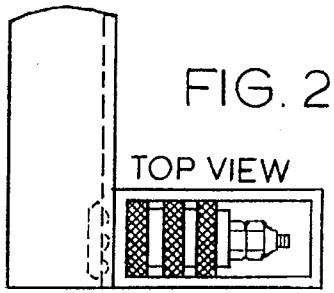
FIG. 24 is a top plan view of the brake means shown in FIG. 23.
Figure 23:
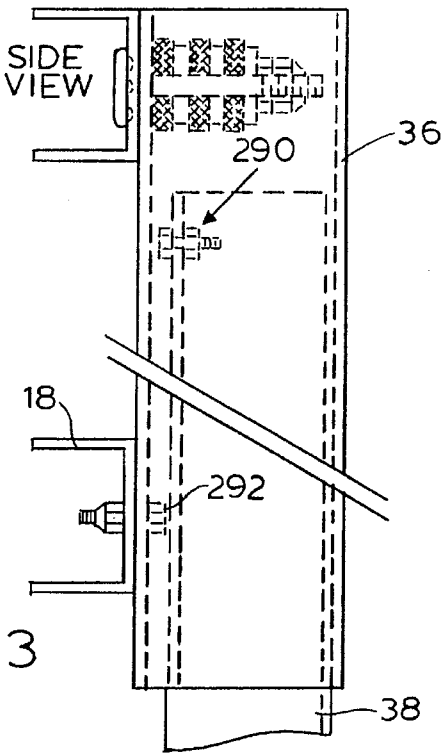
FIG. 23 is a side elevational view of another brake means which connects a crossbar to a stanchion.

A further brake means is shown in FIGS. 23 through 25 and includes a means pivotally connecting the ends of the crossbars to the stanchions. The brake means includes a bolt 250 similar to the bolt shown in FIG. 12, and which includes a bolt head 252 having projections 254 thereon which engage a crossbar to couple the bolt to the crossbar. In some instances, dimples, such as dimple 255 can be defined in the crossbar to receive the projections. Bolt 250 includes a polygonal shank portion 258 and a cylindrical threaded section 260 that extend through bore 262 defined through the crossbar and bore 264 defined through the stanchion and into the interior of the stanchion. The brake means further includes a plurality of metal washers, such as washer 266, each having a polygonal bore, such as bore 268, defined therethrough to couple the washer to the shank, and a plurality of friction pads, such as pad 270, each having a cylindrical bore, such as bore 272, defined therethrough. Each friction pad has a polygonal shape and has edges, such as edge 274, that engage the inner surface, such as inner surface 280, of the stanchion to prevent rotation of the pad with respect to the stanchion. Nuts, such as nut 282, are threaded onto the bolt to force the washers into engagement with the friction pads. Rotation of the bolt 250 is controlled by the frictional engagement between the washers and the friction pads to control movement of the crossbar with respect to the stanchion.

The brake means shown in FIGS. 23–25 can be used alone or in combination with the brake means shown in FIGS. 19–21, which can be used alone or in combination with the just-discussed brake means.

As shown in FIG. 23, stanchion section 38 has a bolt 290 thereon which engages the inner surface of stanchion section 36. Bolt 290 thus guides section 38 in section 36 and engages means 292 connecting crossbar 18 to the stanchion to prevent section 38 from falling out of section 36.

Figure 12:
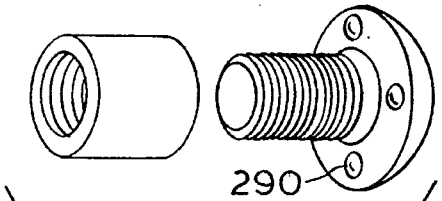
FIGS. 12–14 show various bolts that are used to connect the crossbars of the frame to the stanchions or to the central rung support element.
Figure 13:
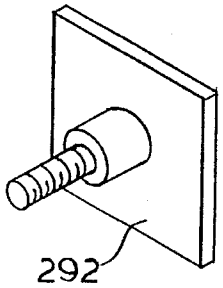

FIGS. 12–14 show various forms of fastener that can be used in any of the brake means. As mentioned above, the bolt can include projections, such as projections 290, which engage either the surface or dimples in the surface, to couple the bolt to a desired element. Other forms of the bolts are shown in FIGS. 13 and 14 as including a polygonal bolt head 292 which engages adjacent surfaces to prevent rotation of the bolt, or bolt head 294 having a rod 296 extending through a cylindrical bore to engage adjacent surfaces for preventing rotation of the bolt.

Figure 3:
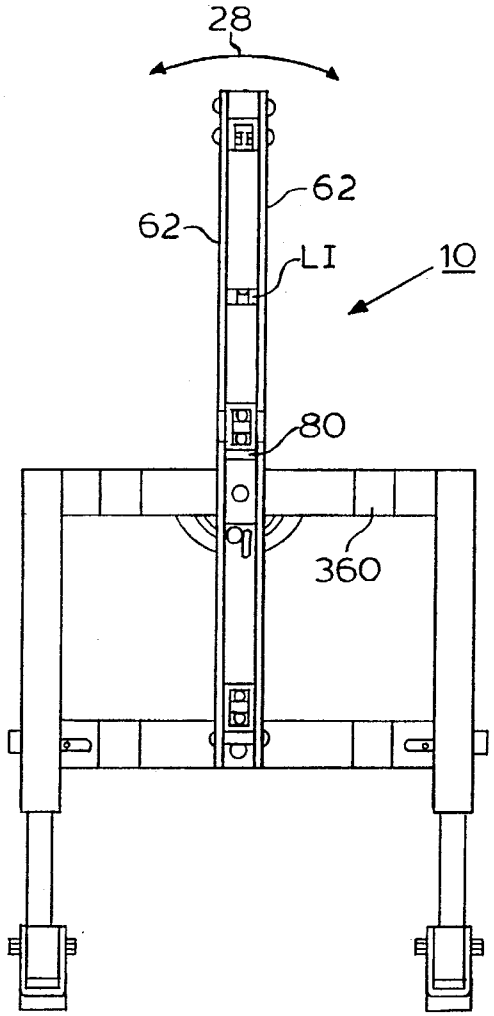
FIG. 3 is a rear elevational view thereof.

As can be seen in FIGS. 5 and 6, the width of the ladder leveler is greater than the width of the ladder. Therefore, the ladder will contact the crossbars. The ladder leveler is preferably made of metal, such as Aluminum, and many ladders are also made of metal, such as Aluminum. Contact between two metals, especially Aluminum, may wear these metals away. Therefore, the ladder leveler includes abutment means for preventing this contact from damaging either the ladder or the leveler. The preferred form of the abutment means is shown in FIGS. 1 and 3 as including pads 360 on the crossbars. The pads preferably are non-friction material, such as plastic, Teflon, or the like.

Figure 26:
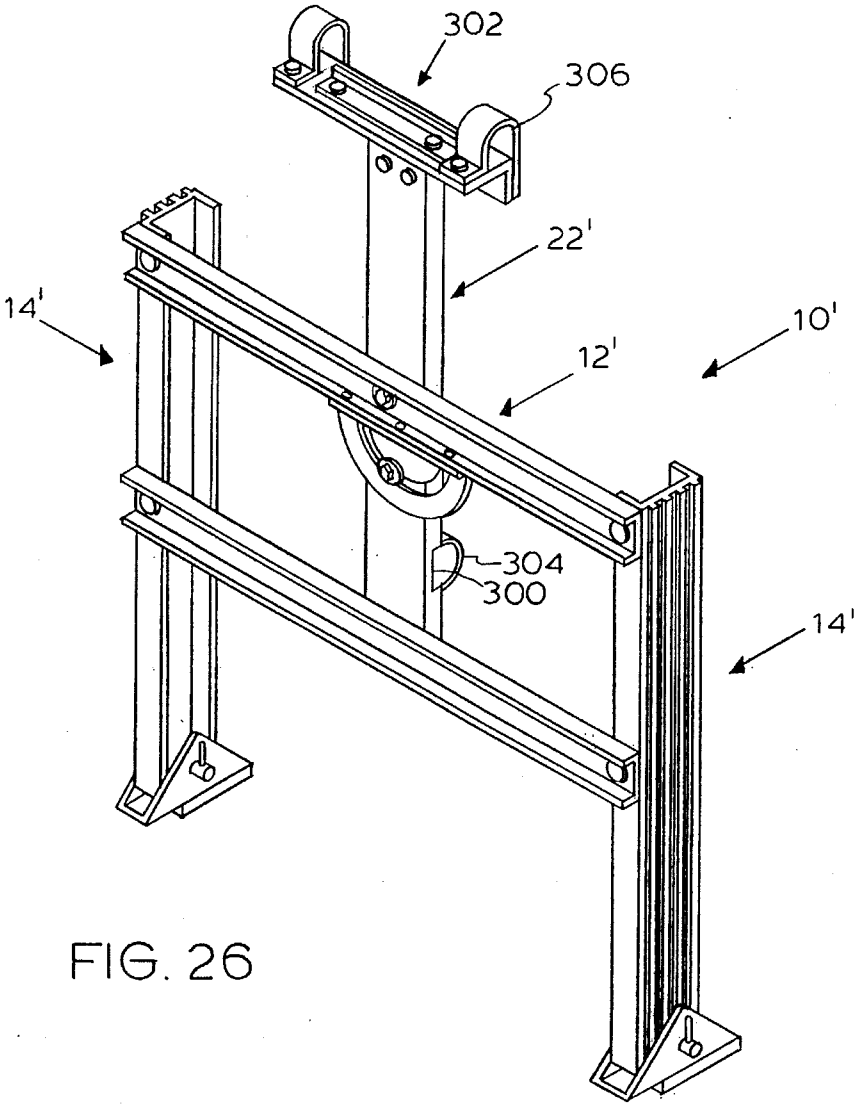
FIG. 26 is an alternate form of the ladder leveler in which two rungs are supported, and which is disclosed in the parent application, Ser. No. 29/010,660, filed on Jul. 14, 1993.

An alternative form of the ladder leveler is shown in FIG. 26 as leveler 10'. Leveler 10' is disclosed in the parent patent application, and includes a frame unit 12' as well as a central post 22'. As can be seen in FIG. 26, leveler 10' includes stanchions 14' that do not telescope, and a rung support means that supports two rungs of the ladder, one in a cutout 300 and one on a platform 302. Straps 304 and 306 encircle ladder rungs and attach those rungs to the respective elements of leveler 10'. Platform 302 fits under a ladder rung for supporting that rung. Leveler 10' is simpler than leveler 10 but performs fewer functions and is not as adjustable or as adaptable as leveler 10. However, leveler 10' may be less expensive to manufacture than leveler 10 and thus may be suitable for certain portions of the market.

It is understood that while certain forms of the present invention have been illustrated and described herein, it is not to be limited to the specific forms or arrangements of parts described and shown.

I claim:

1. A ladder leveler comprising:

A) a frame unit for releasable attachment to a ladder, said frame unit including (1) two stanchions spaced apart a distance that exceeds the outer width dimension of a ladder, each stanchion having a foot section and a top section and means for adjusting the length thereof, (2) two crossbars each attached to said stanchions, (3) fastening means for pivotally attaching each end of each of said crossbars to one of said stanchions so said crossbars can move with respect to said stanchions, (4) a rung support means attached to said frame unit for supporting rungs of the ladder, with one of the rungs being supported from beneath, said rung support means including a cutout section into which a rung of the ladder to be supported is received and a strap which fits around the rung being supported for attaching the rung to said rung support element; and B) brake means for attaching said rung support means to said frame unit and including a first element fixed to one of said crossbars, a second element fixed to said rung support means, a friction pad means for controlling relative movement of said first and second elements and brake setting means for frictionally engaging said first and second elements to said friction pad means.

2. The ladder leveler defined in claim 1 wherein said brake means includes an arcuate slot defined in said first plate, and an element attached to said second plate in position to be received through said arcuate slot.

3. The ladder leveler defined in claim 2 wherein said arcuate slot extends for essentially the entire width of said first plate.

4. The ladder leveler defined in claim 1 further including a support block element on said rung support means.

5. The ladder leveler defined in claim 1 further including bearing means on said crossbars for preventing direct contact between the ladder and said crossbars.

6. The ladder leveler defined in claim 1 wherein said rung supporting means includes a post and a rung abutting element on top of said post for supporting a rung from beneath that rung.

7. The ladder leveler defined in claim 1 wherein said rung supporting means includes a second cutout section.

8. The ladder leveler defined in claim 1 wherein said brake means includes a fastener means for attaching a crossbar end to a stanchion and friction pads interposed between said fastener means and said stanchion.

9. The ladder leveler defined in claim 1 wherein said brake means further includes a handle, means for attaching said handle to said first element, a friction pad element located adjacent to said second element, means for abuttingly engaging said handle to said friction pad element and forcing said friction pad element into engagement with said first element to couple said first and second elements together via said friction pad element.

10. The ladder leveler defined in claim 1 further including a sleeve interposed between the rung and said strap.

11. The ladder leveler defined in claim 1 further including reinforcing means in one of the rungs being supported by said rung supporting means for strengthening the rung being supported.

12. The ladder leveler defined in claim 1 further including a level indicating means on said frame unit.

13. The ladder leveler defined in claim 1 wherein each of said stanchions includes two sections that are telescopingly coupled together.

14. The ladder leveler defined in claim 6 wherein said rung abutting element includes a support plate which fits beneath a rung of the ladder.

15. The ladder leveler defined in claim 14 wherein said rung abutting element further includes a strap for attaching a rung to said support plate.

16. The ladder leveler defined in claim 1 wherein said brake means further includes a bolt means for connecting one crossbar of said crossbars to one stanchion of said stanchions and a brake pad interposed between said bolt means and said one crossbar and said one stanchion.

17. The ladder leveler defined in claim 16 wherein said bolt means includes means for preventing rotation of said bolt means with respect to said one crossbar.

18. The ladder leveler defined in claim 17 wherein said means for preventing rotation includes a polygonal section on said bolt means.

19. The ladder leveler defined in claim 17 wherein said means for preventing rotation includes projections on said bolt means.

20. A ladder leveler comprising:

A) a frame unit for releasable attachment to a ladder, said frame unit including
   (1) two stanchions spaced apart a distance that exceeds the outer width dimension of a ladder, each stanchion having a foot section and a top section and means for adjusting the length thereof,
   (2) two crossbars each attached to said stanchions,
   (3) fastening means for pivotally attaching each end of each of said crossbars to one of said stanchions so said crossbars can move with respect to said stanchions,
   (4) a rung support means attached to said frame unit for supporting rungs of the ladder, with one of the rungs being supported from beneath, said rung support means including a cutout section into which a rung of the ladder to be supported is received and a strap which fits around the rung being supported for attaching the rung to said rung support element; and B) brake means on said frame unit for controlling movement of said rung support element with respect to said stanchions and including a bolt fixed to said rung support element for movement therewith, a fastener element attached to said bolt for movement therewith and a friction pad interposed between said fastener element and a stanchion.

* * * * *